United States Patent [19]

Biodrowski

[11] Patent Number: 4,907,385

[45] Date of Patent: Mar. 13, 1990

[54] DRAINAGE APPARATUS FOR CONCRETE BLOCK WALLS

[76] Inventor: Richard E. Biodrowski, 3525 No. 58th St., Omaha, Nebr. 68104

[21] Appl. No.: 307,619

[22] Filed: Feb. 7, 1989

[51] Int. Cl.[4] ..... E02D 31/02

[52] U.S. Cl. ..... 52/169.5; 405/45; 405/50

[58] Field of Search ..... 405/36, 43, 45, 50; 52/169.5

[56] References Cited

U.S. PATENT DOCUMENTS

| | | | |
|---|---|---|---|
| 349,735 | 9/1886 | Nicaise . | |
| 373,946 | 11/1887 | Richardson . | |
| 2,292,876 | 8/1942 | Gladville . | |
| 3,287,866 | 11/1966 | Bevilacqua | 52/169.5 |
| 3,562,982 | 2/1971 | Parezo | 52/169 |
| 3,656,268 | 4/1972 | Murati | 52/169.5 |
| 3,852,925 | 12/1974 | Gazzo | 52/169 |
| 4,045,964 | 9/1977 | Barclay | 405/50 |
| 4,523,875 | 6/1985 | DiFore | 405/50 |

FOREIGN PATENT DOCUMENTS

| | | | |
|---|---|---|---|
| 1484461 | 2/1963 | Fed. Rep. of Germany . | |
| 2237707 | 2/1974 | Fed. Rep. of Germany | 405/45 |

OTHER PUBLICATIONS

Mirafi® 140N Advertising Literature.
Miradrain® Advertising Literature.

*Primary Examiner*—David H. Corbin
*Attorney, Agent, or Firm*—Zarley, McKee, Thomte, Voorhees & Sease

[57] ABSTRACT

A drainage apparatus is utilized in combination with a hollow core concrete block having a notch extending through one longitudinal wall thereof, to allow water to escape the hollow core. In the preferred embodiment of the invention, a fabric pocket is held upright within the hollow core by a wire frame. The lower end of the wire frame is bent into a J-shape so as to clip onto the concrete block at the notch in the block. The fabric is of a type which will absorb water and permit a high water flow rate, so as to drain water from the surrounding material downwardly through the fabric and out the notch. A second embodiment of the invention utilizes a hollow tubular frame within a fabric pocket. The tubular frame has a plurality of slots cut therein to allow water to seep into the tube and be drained out through the notch in the concrete block. A third embodiment of the invention includes a hollow core concrete block having a notch in its lower edge to drain water from the hollow core, and a channel extending vertically upward from the notch in the core of the block. A fabric is bonded to the concrete block wall over the channel to draw water down the fabric within the channel and thereby drain the liquid through the notch in the concrete block.

7 Claims, 2 Drawing Sheets

DRAINAGE APPARATUS FOR CONCRETE BLOCK WALLS

TECHNICAL FIELD

The present invention relates to apparatus for draining hollow concrete block walls, and more particularly to an improved drainage apparatus which allows drainage regardless of the extent to which the core of the concrete blocks may be filled with excess mortar and dirt.

BACKGROUND OF THE INVENTION

In the construction of structures having concrete block foundation walls, it is typical to provide concrete footings seated in a bed of gravel or crushed stone. Such foundation walls will surround a concrete slab floor which is also seated on crushed stone or the like. For various reasons, water will accumulate in the bottom course of the blocks seated on the footings, and seeps by capillary action, and through cracks, to the interior of the basement. Water can also enter by reason of high water pressure resulting from a high water table which forces water through mortar joints, wall-to-floor joints and any other cracks or punctures in the concrete. In some cases the wall may be so porous that water will naturally seep therethrough.

The usual approach to preventing such water seepage involved the use of a drainage tile in particulate material along the outside of the wall, and an additional tile in particulate material underlying the basement floor slab. Water was then intended to drain into the tiles and flow or be pumped through the tile to a remote point for disposal. However, drainage tiles by themselves have not solved the problem.

Another approach to preventing such water leakage, is in attempting to patch all cracks and holes in the wall. Obviously such repair is difficult and expensive because all of the soil against the wall must first be removed prior to such patching or repairing.

Other attempts to provide drainage for concrete block walls involved the formation of drainage holes extending from the interior of the bottom course of blocks to a drainage trench or the like. While this method proved more successful, it still suffered drawbacks, because excess mortar and backfill dirt would fall within the interior core of the concrete block walls during their construction. This excess mortar and dirt would then plug the holes in the bottom course of the wall and cause water to accumulate within the wall.

It is therefore a general object of the present invention to provide an improved apparatus for draining concrete block walls.

Another object of the present invention is to provide a wall drainage apparatus which is not subject to plugging by excess mortar or backfill dirt.

A further object is to provide drainage apparatus which is simple and economical to install during the construction of the concrete block wall.

These and other objects will be apparent to those skilled in the art.

SUMMARY OF THE INVENTION

The drainage apparatus of the present invention is utilized in combination with a hollow core concrete block having a notch extending through one longitudinal wall thereof to allow water to escape the hollow core. In the preferred embodiment of the invention, a fabric pocket is held upright within the hollow core by a wire frame. The lower end of the wire frame is bent into a J-shape so as to clip onto the concrete block at the notch in the block. The fabric is of a type which will absorb water and permit a high water flow rate, so as to drain water from the surrounding material downwardly through the fabric and out the notch.

A second embodiment of the invention utilizes a hollow tubular frame within a fabric pocket. The tubular frame has a plurality of slots cut therein to allow water to seep into the tube and be drained out through the notch in the concrete block.

A third embodiment of the invention includes a hollow core concrete block having a notch in its lower edge to drain water from the hollow core, and a channel extending vertically upward from the notch in the core of the block. A water conducting fabric is bonded to the concrete block wall over the channel to draw water down the fabric within the channel and thereby drain the liquid through the notch in the concrete block.

DESCRIPTION OF THE PREFERRED EMBODIMENT

Figure 1:
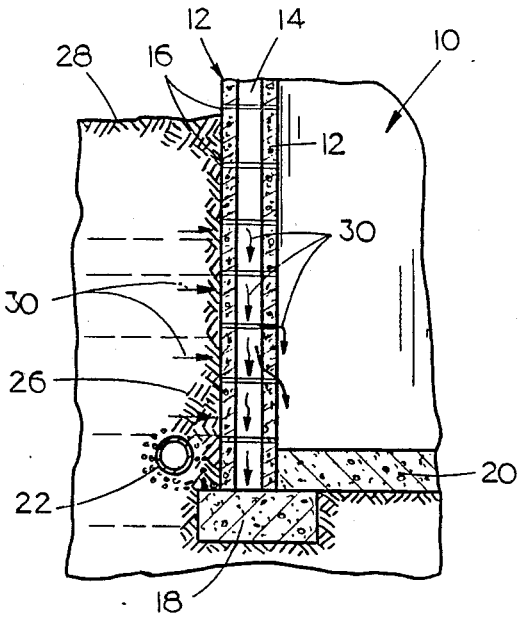
FIG. 1 is a sectional view through a conventional foundation wall and concrete floor slab.

Referring now to the drawings, in which identical or corresponding parts are identified with the same reference numeral, and more particularly to FIG. 1, a conventional concrete block wall is designated generally at 10 and is formed of several vertically-stacked courses of concrete blocks 12 having a hollow interior 14. Each course is separated by a mortar joint 16 such that concrete blocks 12 are stacked with their hollow portions 14 aligned. The wall 10 is seated on a concrete footing 18, which also supports one edge of the floor slab 20. Typically, a drainage tile 22 is laid in a bed of gravel 24 along the exterior of the wall adjacent to footings 18, to provide some drainage of water from the exterior of the wall. Backfill dirt 26 then is placed on top of the tile up to ground level 28. Water in the soil is indicated generally by arrows 30 which seeps through mortar joints 16, porous block 12 or cracks or the like so as to flow downwardly through hollow cores 14 within the concrete block wall 10.

Figure 2:
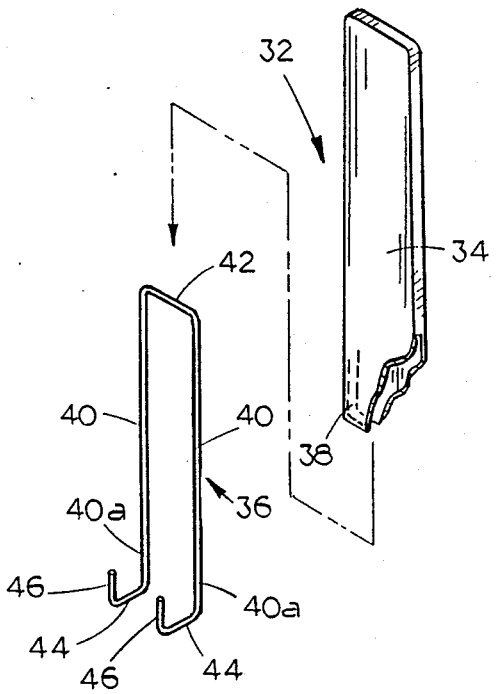
FIG. 2 is an exploded perspective view of the drainage apparatus of the present invention.
Figure 3:
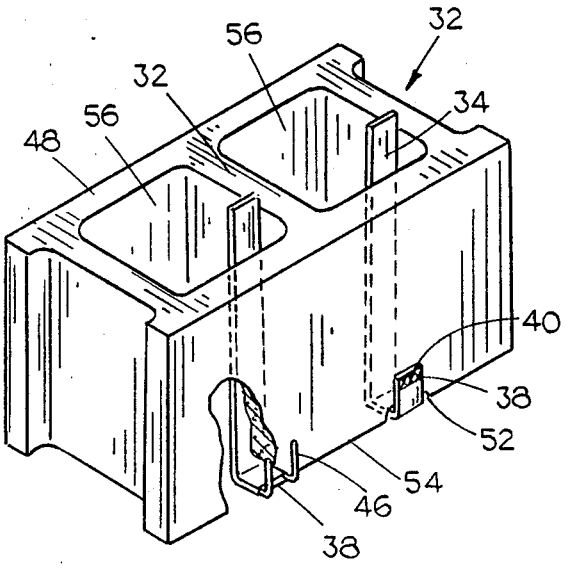
FIG. 3 is a perspective view of the present invention mounted in the lower course of a concrete block wall.
Figure 4:
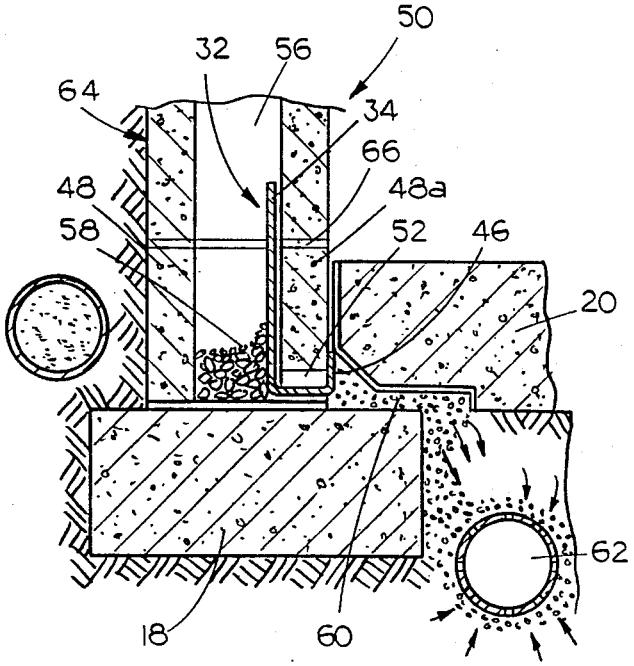
FIG. 4 is a sectional view of the lower portion of a basement wall and floor slab with the present invention installed therein.

Referring now to FIGS. 2–4, the drainage apparatus of the present invention is designated generally at 32 and includes a fabric pocket 34 mounted on a wire frame 36. Fabric pocket 34 preferably consists of a non-woven fabric with a high water flow rate and high puncture and burst resistance. One material which has been found to be suitable for such purposes is produced under the brand name "Mirafi® 140N" by Mirafi, Inc. Fabric 34 is formed into a pocket shape with an open lower end 38 so as to allow insertion of wire frame 36 therein.

Wire frame 36 includes a pair of parallel and vertically oriented legs 40 connected at their upper end by a cross member 42. The lower ends 40*a* of legs 40 are bent into a J-shape orientation having a generally horizontal portion 44 and an upstanding end 46, as shown in the drawings. The length of horizontal portion 44 is generally equal to the thickness of the wall of the concrete block 48 upon which the drainage apparatus 32 will be mounted. In this way, ends 46 on wire frame 36 will resiliently clip onto the wall of concrete block 48, as shown in FIGS. 3 and 4.

Wire frame 36 is first inserted into fabric pocket 34, such that the lower end 38 of pocket 34 extends completely over legs 40, and thence over horizontal portions 44 at the lower ends 40*a* of frame 36. In some cases, it may be preferable to utilize a pocket 34 of a length which will extend completely over frame 36 and project upwardly over upstanding ends 46 such that the lower end 38 may be sewed shut as indicated at 40 in FIG. 3, to totally encase the wire frame 36 therein. The only critical factor involved with the length of fabric pocket 34 is that pocket 34 extend to the lower end 40*a* of leg members 40.

Each drainage apparatus 32 is installed during construction of a concrete block wall 50, as shown in FIGS. 3 and 4. The first, lower course of concrete blocks 48 are of a type having a notch 52 cut into the lower edge 54 of one longitudinal wall 48*a* which extends therethrough into the hollow core 56. As discussed hereinabove, notches 52 were designed to drain water which may collect within cores 56, but were generally ineffective because of excess mortar and backfill dirt, designated generally at 58 in FIG. 4, which would collect and plug notches 52. The first course of concrete blocks 48 are mounted on footing 18 with notches 52 directed inwardly towards the concrete floor slab 20. As shown in FIG. 4, a thin layer of gravel 60 is formed adjacent the inner lower edge of concrete blocks 48 and extends across the footing 18 and downwardly to a drainage tile 62. In this fashion, water drained from lower course 48 will flow through gravel 60 to drainage tile 62, and thence to a sump pump or other disposal area. A drainage apparatus 32 is mounted in each core 56 of each concrete block 48 with the upright legs 46 clipped onto wall 48*a* of the concrete block. Preferably, fabric pocket 34 and legs 40 of frame 36 are of a length which will extend upwardly beyond the first course of concrete blocks 48 partially into the second course of concrete blocks, designated generally at 64, beyond the mortar joint 66 separating the first and second courses.

Once mounted within the foundation wall, the fabric pocket 34 on the drainage device 32 acts as a wick to draw water into the material, the water flowing to notch 52 to be drained into gravel 60 and thence to tile 62. Even with the accumulation of excess mortar and backfill dirt 58, the wicking action of fabric pocket 34 will continuously drain water from hollow cores 56.

Figure 5:
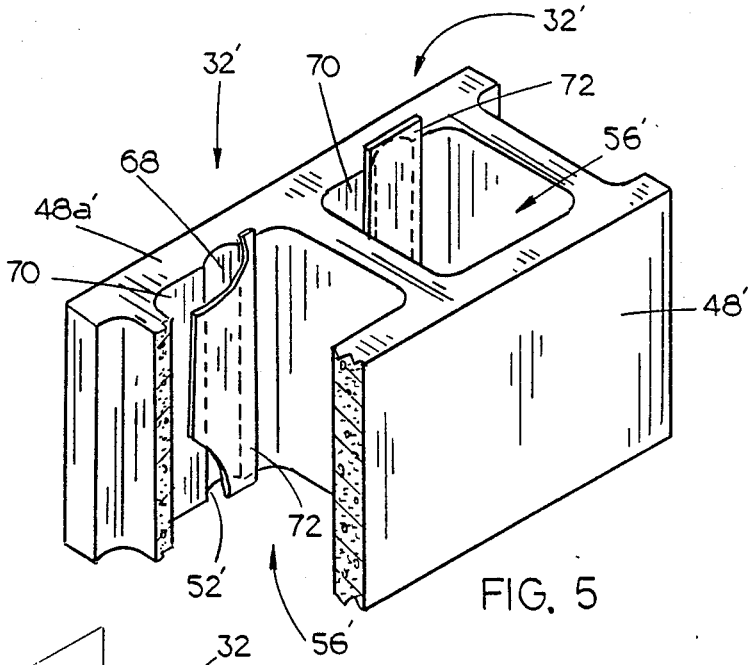
FIG. 5 is a perspective view of a second embodiment of the present invention installed in the lower course of a concrete block wall.

A second embodiment of the invention is shown in FIG. 5, and is designated generally at 32'. In this version of the invention, the lower course of concrete blocks 48' each have a notch 52' in the lower edge of one longitudinal face 48*a'* in a fashion similar to the first embodiment. In this second embodiment of the invention each concrete block 48' is modified by forming a vertical channel 68 on the interior face 70 of longitudinal wall 48*a'*, which extends vertically from notch 52' to the upper edge of block 48'. An elongated layer of high water flow rate fabric 72 is bonded to wall 70 and extends over channel 68 from the lower edge to slightly above the upper edge of concrete block 48'. Fabric 72 is of the same type utilized in drainage apparatus 32 of the first embodiment of the invention and serves to draw water through channel 68 and drain the water out through notch 52'. In this version of the invention, fabric 72 is preferably bonded to concrete blocks 48' prior to use of the block, such that construction of the concrete wall can proceed without additional time and labor in installing the fabric during construction of the wall.

Figure 6:
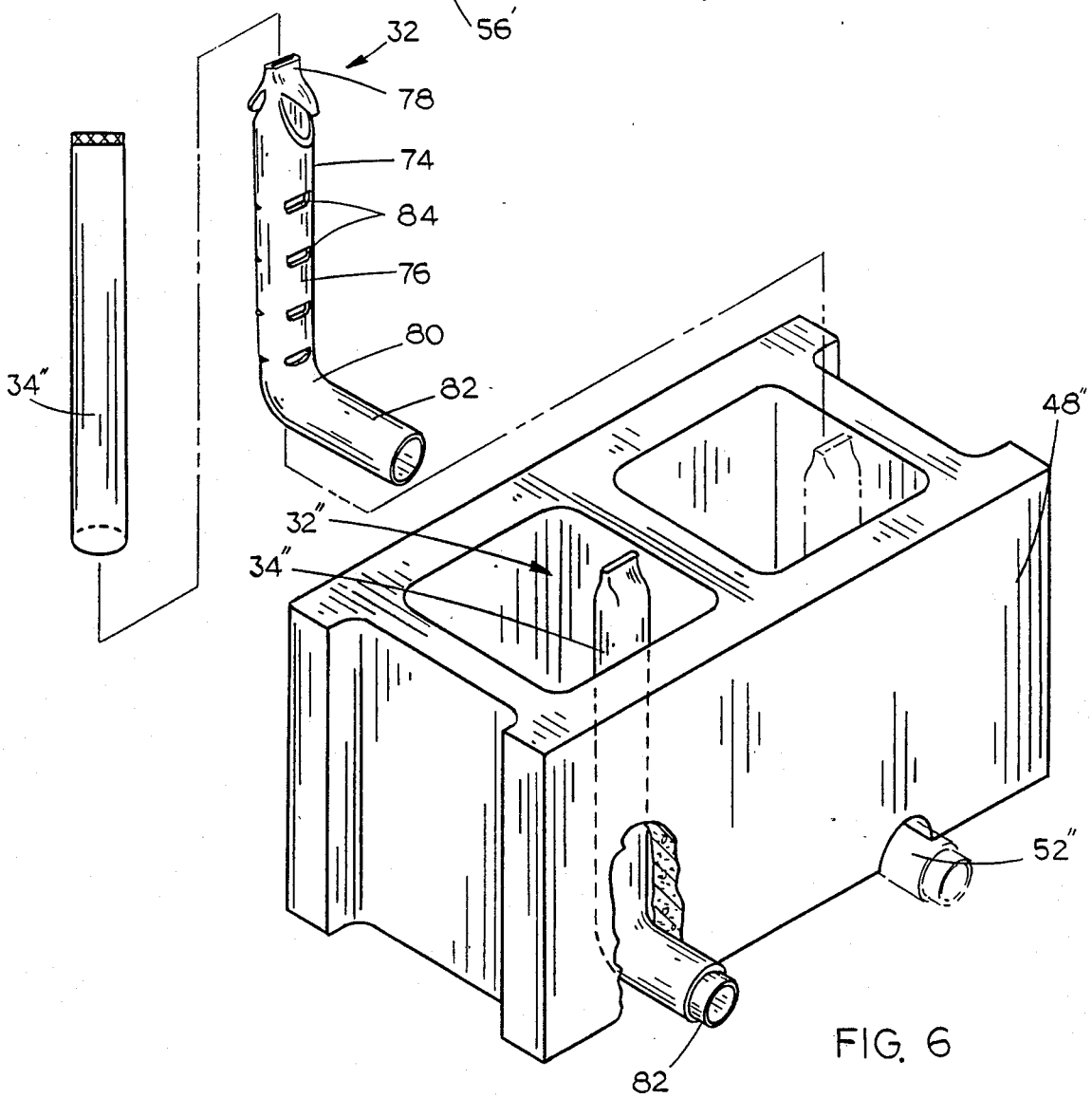
FIG. 6 is an exploded perspective view of a third embodiment of the invention.

Referring now to FIG. 6, a third embodiment of the invention is designated generally at 32", which differs from the first embodiment 32 in the use of a tubular type frame 74 within the fabric pocket 34". Frame 74 is formed from an elongated tube 76 which is closed at the upper end 78 and bent at its lower end 80 so as to have a horizontal portion 82 which projects through notch 52" in block 48". Elongated tube 76 has a series of slots 84 formed therein to allow water to seep into the tube. Pocket 34" is fitted over tube 76 so as to act both as a filter and to draw water from the surrounding material into the tube.

Whereas the invention has been shown and described in connection with the preferred embodiment thereof, it will be understood that many modifications, substitutions and additions may be made which are within the broad scope of the appended claims. For example, various different types of rigid frames may be inserted within a fabric pocket so as to keep the fabric in a generally upright position within the hollow core of a concrete block. The fabric is utilized as a wick to draw water and drain it from the block, regardless of the specific shape of the frame work. Thus, there has been shown and described an improved drainage apparatus which accomplishes at least all of the above stated objects.

I claim:

1. A drainage apparatus for hollow core concrete block walls, comprising:

an elongated support frame having upper and lower ends;

said support frame including a pair of spaced-apart, vertically-oriented leg members connected at their upper ends to form an inverted generally U-shaped frame;

fabric attached to said support frame and extending between said upper and lower ends and between said leg members;

said fabric of a type which will absorb water and will permit water to flow therethrough from said upper end to said lower end, to thereby drain water from the core of a concrete block.

2. The apparatus of claim 1, wherein said leg members have a J-shaped lower end adapted to clip on to the lower edge of a concrete block, and wherein said fabric extends along said J-shaped end to divert the direction of water flowing through said fabric from the upper end to the lower end.

3. In combination:

a hollow concrete block, said block having first and second opposing longitudinal walls, and upper and lower ends;

said concrete block further characterized as having a notch in the lower end of said first longitudinal wall which communicates therethrough to the hollow core of said block; and a drainage apparatus disposed within the hollow core of said concrete block, including:

an elongated generally vertically disposed support frame having upper and lower ends, the lower end thereof being located adjacent said concrete block notch;

said support frame including a pair of spaced apart, vertically-oriented leg members connected at their upper ends to form an inverted generally U-shaped frame; and fabric attached to said support frame and extending between said upper and lower ends and between said leg members;

said fabric of a type which will absorb water and will permit water to flow therethrough from said upper end to said lower end, to thereby drain water from the core of said concrete block.

4. The combination of claim 3, wherein said leg members have a J-shaped lower end extending through said notch, and wherein said fabric extends along said J-shaped end to divert water flowing through said fabric from the hollow core and through said notch.

5. In combination:

a hollow concrete block, said block having first and second opposing longitudinal walls, and upper and lower ends;

said concrete block further characterized as having a notch in the lower end of said first longitudinal wall which communicates therethrough to the hollow core of said block; and a drainage apparatus disposed within the hollow core of said concrete block, including:

said concrete block being further characterized as having a channel formed in the core-facing surface of said first longitudinal wall, extending generally vertically from said notch; and a fabric layer mounted to said first longitudinal wall and covering said channel, said fabric extending from said notch to the upper end of said block, said fabric being water-permeable to allow water to pass therethrough to said channel to flow downwardly to said notch;

said fabric further being of a type which will absorb water and will wick water from said upper end to said lower end, to thereby drain the water.

6. In combination:

a hollow concrete block, said block having first and second opposing longitudinal walls, and upper and lower ends;

said concrete block further characterized as having a notch in the lower end of said first longitudinal wall which communicates therethrough to the hollow core of said block; and a drainage apparatus disposed within the hollow core of said concrete block, including:

a fabric layer oriented vertically within said hollow core, said fabric extending from said notch to the upper end of said block;

support means for supporting said fabric in a generally vertically-oriented position within said core; and said fabric of a type which will absorb water and will wick water from said upper end to said lower end, to thereby drain water from said core.

7. In combination:

a wall formed of concrete blocks, and having upper and lower ends and inner and outer faces;

said concrete blocks having hollow cores extending vertically therethrough;

said wall having at least one aperture located at the lower end of the inner face and extending through said inner face to communicate with a hollow core; and a drainage apparatus disposed within a hollow core and extending through said aperture, including:

a fabric layer oriented vertically within said hollow core, said fabric extending upwardly from said aperture;

support means for supporting said fabric in a generally vertically-oriented position within said core; and said fabric of a type which will absorb water and will wick water downwardly therethrough, to thereby drain water from said core, through said aperture.

* * * * *